US010609993B2

(12) United States Patent
Brenner

(10) Patent No.: US 10,609,993 B2
(45) Date of Patent: Apr. 7, 2020

(54) DISPLAY DEVICE FOR A WALKER

(71) Applicant: Michael J Brenner, St. Louis, MO (US)

(72) Inventor: Michael J Brenner, St. Louis, MO (US)

(73) Assignees: Michael J. Brenner, St. Louis, MO (US), Trustees, or their sucessors in trust, under the BRENNER LIVING TRUST, dated Jun. 22, 2016, and any amendments thereto; Joann Brenner, St Louis, MO (US), Trustees, or their sucessors in trust, under the BRENNER LIVING TRUST, dated Jun. 22, 2016, and any amendments thereto ( * ) Notice: Subject to any disclaimer, the term of this patent is extended or adjusted under 35 U.S.C. 154(b) by 0 days.

(21) Appl. No.: 16/165,340

(22) Filed: Oct. 19, 2018

(65) Prior Publication Data

US 2019/0059532 A1 Feb. 28, 2019

Related U.S. Application Data

(63) Continuation of application No. 15/692,651, filed on Aug. 31, 2017, now Pat. No. 10,111,506.

(51) Int. Cl.

| | |
|---|---|
| ***A45B 3/04*** | (2006.01) |
| ***A61H 3/00*** | (2006.01) |
| ***A61H 3/02*** | (2006.01) |

(52) U.S. Cl.

CPC ..... *A45B 3/04* (2013.01); *A61H 3/00* (2013.01); *A61H 2003/002* (2013.01); *A61H 2003/005* (2013.01); *A61H 2003/007* (2013.01); *A61H 2003/0205* (2013.01); *A61H 2201/0188* (2013.01); *A61H 2201/5043* (2013.01)

(58) Field of Classification Search

None

See application file for complete search history.

(56) References Cited

U.S. PATENT DOCUMENTS

| | | | | | |
|---|---|---|---|---|---|
| 3,957,071 | A * | 5/1976 | Kenner | A61H 3/00 | 135/66 |
| 4,056,219 | A * | 11/1977 | Hine, Jr. | B62J 7/06 | 224/438 |
| 5,125,712 | A * | 6/1992 | Stamoutsos | B62B 9/00 | 280/1.13 |
| 5,215,379 | A * | 6/1993 | Pickard | A47F 7/142 | 224/222 |
| D352,260 | S * | 11/1994 | Adamo | D12/133 | |
| 5,507,109 | A * | 4/1996 | Rinzler | G09F 15/0025 | 160/329 |

(Continued)

*Primary Examiner* — David R Dunn

*Assistant Examiner* — Christopher E Veraa

(74) *Attorney, Agent, or Firm* — David H. Chervitz

(57) ABSTRACT

A display device for a walker is disclosed which has a panel having a front surface, a back surface, a left side, a right side, an upper side, a lower side, and printed matter printed on the front surface, a first left side attachment device and a second left side attachment device each extending out from the left side of the panel, a first right side attachment device and a second right side attachment device each extending out from the right side of the panel, an upper attachment device extending out from the upper side, a lower attachment device extending out from the lower side, and a back attachment device extending out from the back surface.

20 Claims, 11 Drawing Sheets

(56) References Cited

U.S. PATENT DOCUMENTS 5,531,238 A 7/1996 Azzarelli et al.
5,843,556 A * 12/1998 Levas ..... A45F 4/02 428/99
5,862,825 A 1/1999 Leonard
6,006,462 A * 12/1999 Lackomar ..... B60R 7/043 108/44
6,029,875 A * 2/2000 Johnston ..... A45C 13/36 224/153
6,302,126 B1 10/2001 Nava
6,651,683 B1 * 11/2003 Hooks ..... A45F 5/00 135/66
7,377,285 B2 5/2008 Karasin et al.
7,984,724 B1 * 7/2011 Eberle ..... A61H 3/04 135/66
9,427,055 B2 * 8/2016 Bullock ..... A45C 7/0077
2004/0216339 A1 * 11/2004 Garberg ..... A47F 5/137 40/308
2007/0094906 A1 * 5/2007 Milligan ..... G09F 15/00 40/604
2007/0278271 A1 * 12/2007 Koren ..... A45C 3/00 224/407
2008/0084690 A1 * 4/2008 Rappl ..... F21V 21/0832 362/184
2009/0222334 A1 * 9/2009 Shepherd ..... G06Q 30/0241 705/14.4
2010/0050485 A1 * 3/2010 Forte ..... G09F 21/02 40/1.5
2010/0319605 A1 * 12/2010 Petrenko ..... G09F 17/00 116/173
2012/0117838 A1 * 5/2012 Riley ..... G09F 7/00 40/582
2013/0214019 A1 * 8/2013 Wu ..... B62J 11/00 224/413
2013/0256357 A1 * 10/2013 Prosperie ..... A45C 11/00 224/572
2017/0189258 A1 7/2017 Ott et al.

* cited by examiner

DISPLAY DEVICE FOR A WALKER

RELATED APPLICATION

This application is a continuation of U.S. patent application Ser. No. 15/692,651, filed on Aug. 31, 2017, which is now U.S. Pat. No. 10,111,506, the disclosure of which is incorporated herein by reference.

BACKGROUND

This disclosure relates generally to a display device for a walker, and more particularly to a display device for a walker that allows a user of the walker to personalize or customize the walker to be able to differentiate the walker from other walkers.

As a person ages it may become difficult to walk without assistance of an ambulatory device such as a walker. The walker is used to support a person to provide stability and balance when walking or standing. Typically, a walker consists of an assembly of various members such as a pair of side frames, a central frame, wheels, and glides. The walker may be collapsible or folded for storage when not in use. The side frames may have handle grips for the person to grasp when using the walker. The central frame may include various horizontal members that provide stability for the walker. Other devices, such as a braking system, may also be included with the walker. As can be appreciated, while it may appear that a walker is a standard utilitarian device, there are various different shapes, sizes, assemblies, constructions, and options provided by various manufacturers.

Although walkers are very useful devices they do tend to be bland or utilitarian in nature and appearance. For example, most of the components of the walker are manufactured in a silver or gray color. The glides, if used, appear in a silver, gray, or black color. The wheels may also have a silver or gray color in appearance. Also, the handles or hand grips are black or gray. As such, the walker does not present a cheerful appearance. This appearance may also impact the user who would also like to draw attention away from the walker and the health condition associated with the use of the walker.

The present disclosure is designed to obviate and overcome many of the disadvantages and shortcomings experienced with prior unadorned walkers. Moreover, the present disclosure is related to a display device for a walker that can be utilized to customize the walker for providing a more cheerful or healthy appearance. The display device for a walker of the present disclosure is simple to use and does not require any retrofitting or modifying of an existing walker. The present disclosure is also directed to a display device for a walker that also functions to add a youthful appearance to the walker to provide a healthier disposition for the user of the device.

SUMMARY

In one form of the present disclosure, a display device for a walker is disclosed which comprises a panel having a front surface, a back surface, a left side, a right side, an upper side, a lower side, and printed matter printed on the front surface, a first left side attachment device and a second left side attachment device each extending out from the left side of the panel, a first right side attachment device and a second right side attachment device each extending out from the right side of the panel, an upper attachment device extending out from the upper side, a lower attachment device extending out from the lower side, and a back attachment device extending out from the back surface.

In another form of the present disclosure, a display device for a walker comprises a front panel having a front surface, a back surface, a left side, a right side, an upper side, a lower side, and printed matter printed on the front surface, a first left side attachment device and a second left side attachment device each extending out from the left side of the panel, a first right side attachment device and a second right side attachment device each extending out from the right side of the panel, an upper attachment device extending out from the upper side, a lower attachment device extending out from the lower side, and a back attachment device extending out from the back surface, a first panel having a front surface, a back surface, a left side, a right side, an upper side, a lower side, and printed matter on the front surface, a first left side attachment device and a second left side attachment device each extending out from the left side of the panel, a first right side attachment device and a second right side attachment device each extending out from the right side of the panel, and a second panel having a front surface, a back surface, a left side, a right side, an upper side, a lower side, and printed matter on the front surface, a first left side attachment device and a second left side attachment device each extending out from the left side of the panel, a first right side attachment device and a second right side attachment device each extending out from the right side of the panel.

In still another form of the present disclosure, a display device for a walker comprises a panel having a front surface, a back surface, a left side, a right side, an upper side, a lower side, and printed matter printed on the front surface, a series of grommets positioned along the left side of the panel, a series of grommets positioned along the right side of the panel, and a number of attachment devices for insertion through the grommets for attaching the panel to a walker.

In yet another form of the present disclosure, a display device for a walker comprises a panel having a front surface, a back surface, an upper side, a left side, a lower side, a right side, an upper portion, a lower portion with the upper portion being separated from the lower portion by a fold line, the upper portion on the back surface having a first upper strip of hook and loop fastening material and a second upper strip of hook and loop fastening material, the lower portion on the back surface having a first lower strip of hook and loop fastening material and a second lower strip of hook and loop fastening material with the first upper strip of hook and loop fastening material for mating with the first lower strip of hook and loop fastening material and the second upper strip of hook and loop fastening material for mating with the second lower strip of hook and loop fastening material for the lower portion and the upper portion forming a pocket on the back surface when the strips of material are matted together.

In light of the foregoing comments, it will be recognized that the display device for a walker of the present disclosure is of simple construction and design and which can be easily employed with highly reliable results.

The present disclosure provides a display device for a walker that can be attached to the walker without interfering with the use of the walker.

The present disclosure provides a display device for a walker that does not require removal from the walker when the walker is in a collapsed state or a stored state.

The present disclosure provides a display device for a walker that is lightweight and compact and does not add any weight to the walker to impair use of the walker.

The present disclosure also provides a display device for a walker that allows an individual to customize the appearance of the walker with various photographs, logos, or other visual images or items.

The present disclosure further provides a display device for a walker that is compact and may easily be carried, stored, transported, inventoried, assembled, and operated.

The present disclosure provides a display device for a walker that can be constructed using readily available materials and printing techniques.

The present disclosure also provides a display device for a walker that is inexpensive and is capable of being used on a continuous basis.

The present disclosure is further directed to a display device for a walker that can function as an advertisement when the walker is in use.

The present disclosure further provides a display device for a walker that is not permanently attached to the walker and may be easily removed from the walker.

These and other advantages of the present disclosure will become apparent after considering the following detailed specification in conjunction with the accompanying drawings, wherein:

DETAILED DESCRIPTION OF A PREFERRED EMBODIMENT

Figure 1:
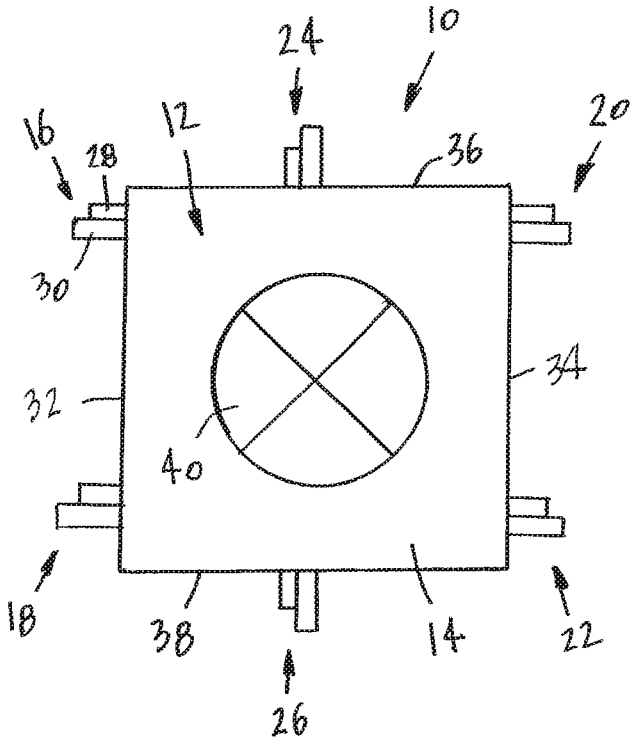
FIG. 1 is a front view of a display device for a walker constructed according to the present disclosure.

Referring now to the drawings, wherein like numbers refer to like items, number 10 identifies a preferred embodiment of a display device for a walker constructed according to the present disclosure. With reference now to FIG. 1, the display device for a walker 10 is shown to comprise a panel 12 constructed of any suitable material, such as cloth, paper, paperboard, cardboard, synthetic material, or a combination thereof. The panel 12 has a front surface or side 14, a first left side attachment device 16, a second left side attachment device 18, a first right side attachment device 20, a second right side attachment device 22, an upper attachment device 24, and a lower attachment device 26. By way of example only, the first left side attachment device 16 comprises a first tab portion 28 and a second tab portion 30. As can be appreciated, the tab portions 28 and 30 may be tied together. The tab portions 28 and 30 are each a generally rectangular piece of material. Each of the other attachment devices 18, 20, 22, 24, and 26 are similarly constructed. The panel 12 has the front side 14, a first or left side 32, a second or right side 34, an upper or top side 36, and a lower or bottom side 38. The first and second left attachment devices 16 and 18 extend out from the left side 32 and the first and second right attachment devices 20 and 22 extend out from the right side 34. The upper attachment device 24 extends out from the top side 36. The lower attachment device 26 extends out from the lower side 38. The front side 14 may have printed thereon various items such as a photograph 40. The photograph 40 is shown as being an X inside a circle. It is also contemplated that other items or designs may appear or be printed on the front side 14 such as logos, advertisements, colors, pictures, famous paintings, a combination thereof, and any other printed matter. By way of example only, it is possible to take a picture of a grandchild and to upload the image to have the image printed on the panel 12 as the photograph 40.

Figure 2:
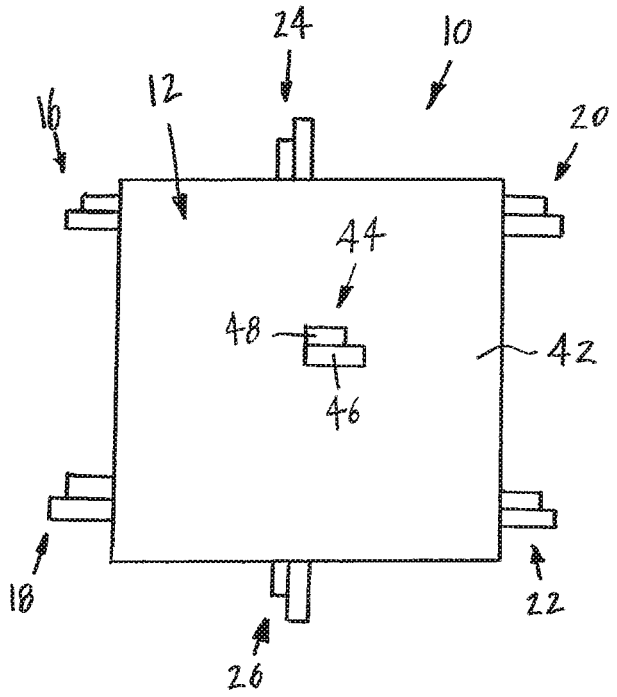
FIG. 2 is a back view of the display device for a walker constructed according to the present disclosure shown in a disassembled state.

FIG. 2 illustrates a back view of the display device for a walker 10. The panel 12 is shown to have a back surface or side 42 having a back attachment device 44 extending out from the back side 42. The back attachment device 44 comprises a first tab portion 46 and a second tab portion 48. The back attachment device 44 is used to attached or secure the back side 42 to a walker (not shown). The panel 12 is also shown to have the other attachment devices 16, 18, 20, 22, 24, and 26 extending out from the panel 12. It should be noted that there is no printing on the back side 42 of the panel 12. However, it is possible and contemplated that some printing may be placed on the back side 42, such as instructions of use of the device 10 or other information such as emergency numbers. As will be explained more fully herein, the attachment devices 16, 18, 20, 22, 24, 26, and 44 may take on other forms which include hook and loop fastening material. Further, although the attachment devices 16, 18, 20, 22, 24, 26, and 44 are disclosed and discussed, it is also possible that more or less attachment devices will be required depending on the particular walker to which the display device 10 is attached.

Figure 3:
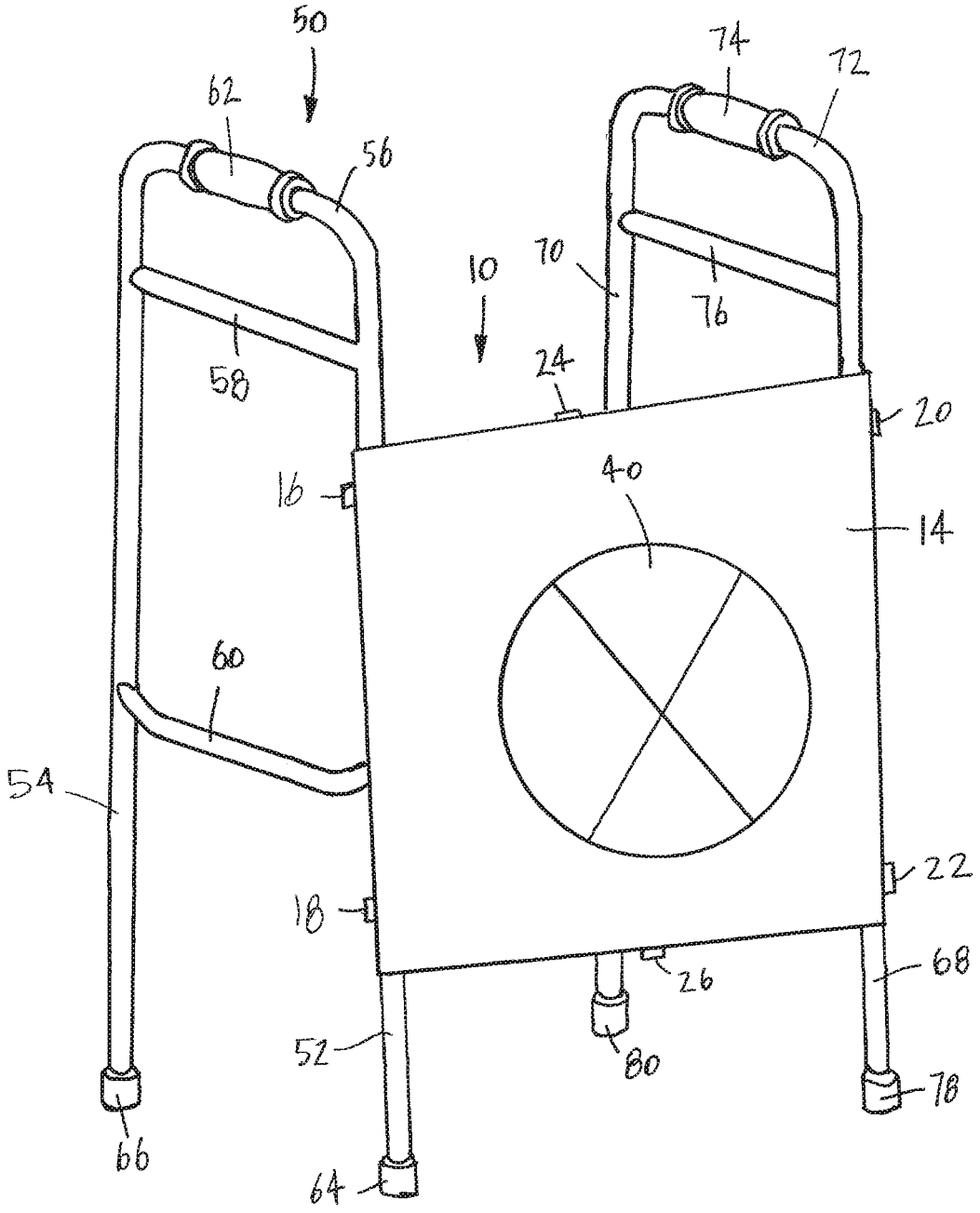
FIG. 3 is a perspective view of the display device for a walker constructed according to the present disclosure being attached to a walker.

Referring now in particular to FIG. 3, the device 10 is shown attached to a walker 50. The walker 50 consists of a left side front leg member 52, a left side rear leg member 54, an upper connecting member 56 connected between the leg members 52 and 54, a first left upper horizontal member 58 connected between the leg members 52 and 54, and a first left lower horizontal member 60 connected between the leg members 52 and 54. The horizontal members 58 and 60 are used to provide stability or bracing for the walker 50. The upper connecting member 56 may also include a hand grip 62. The left side front leg member 52 and the left side rear leg member 54 may each have a rubber foot 64 and 66, respectively, for contacting the floor and for safety. Although not shown for this particular walker 50, it is possible that instead of the rubber foot 64 there may be a wheel for providing easier mobility of the walker 50. The walker 50 also has a right side front leg member 68, a right side rear leg member 70, and an upper connecting member 72 connected between the leg members 68 and 70. The upper connecting member 72 may also include a hand grip 74. The walker 50 also has a first right upper horizontal member 76 connected between the leg members 68 and 70. Although obstructed by the device 10 in this particular view, the walker 50 also has other horizontal member, similar to the horizontal member 60. The right side front member 68 and the right side rear leg member 70 each have a rubber foot 78 and 80, respectively. Again, it should be noted that the rubber foot 78 could be replaced by a wheel. As has been previously indicated, the walker 50 may take on various forms, shapes, and sizes and may be fitted with other items such as a braking system. Although not shown in this particular view, there is one or more cross members connected between the left side front leg member 52 and the right side front leg member 68. The device 10 is shown being connected to the walker 50 by use of the attachment devices 16 and 18 being attached to the left side front leg member 54, the attachment devices 20 and 22 being attached to the right side front leg member 68, the upper attachment device 24 being connected to an obscured cross member, and the lower attachment device 26 being connected to an obscured cross member. It is also possible that the walker 50 may not have such noted obscured cross members. In this case, the attachment devices 24 and 26 may not be required or used. Obscured by the device 10 in this view, the back attachment device 44 may be attached to various cross members associated with the walker 50. In this manner, the device 10 is securely attached to the walker 50 to present the photograph 40 on the front side 14. As can be appreciated, the device 10 does not interfere with the use of the walker 50. Also, the device 10 can be easily removed from the walker 50 by disengaging the attachment devices 16, 18, 20, 22, 24, 26, and 44. The panel 12 may be of any suitable size and shape to be attached to the walker 50.

Figure 4:
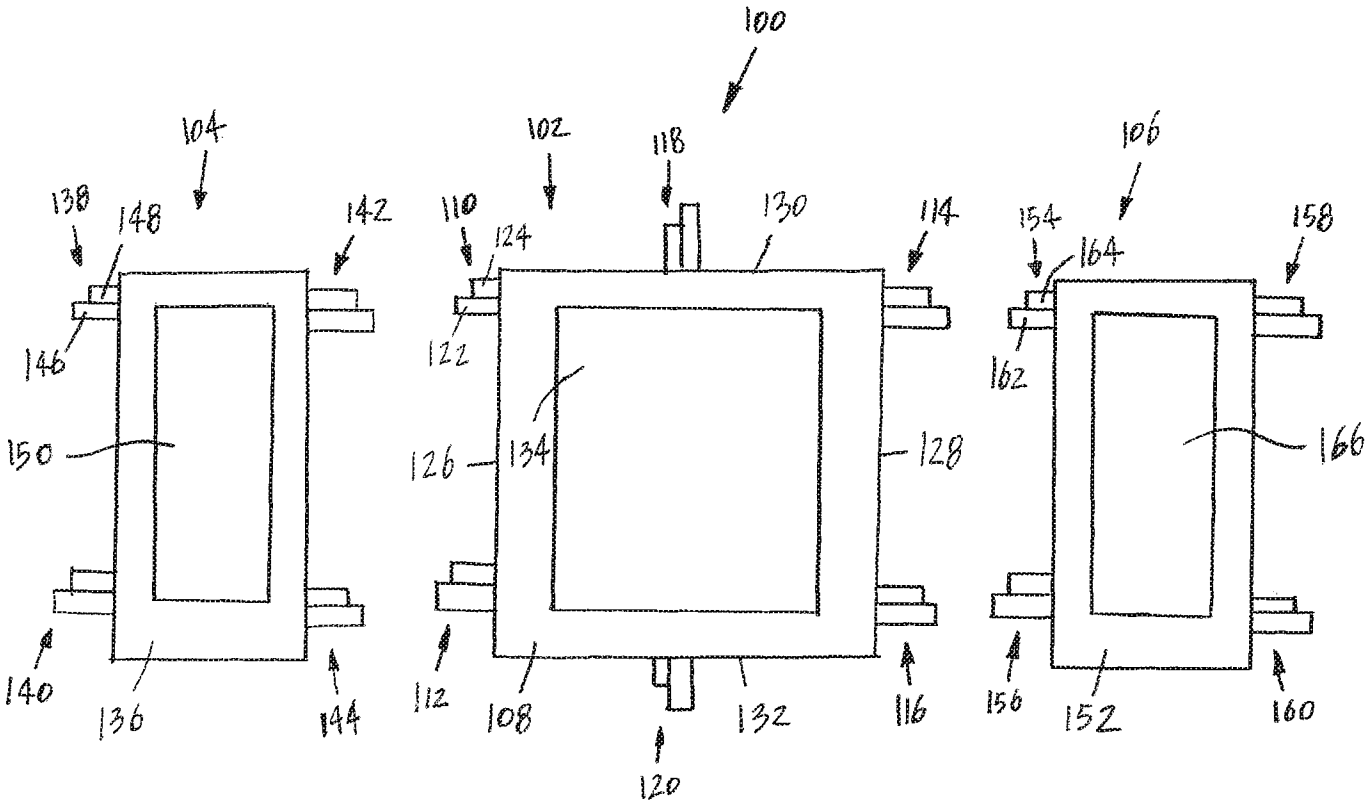
FIG. 4 is a front view of another display device for a walker constructed according to the present disclosure.

FIG. 4 illustrates another embodiment of a display device for a walker 100 constructed according to the present disclosure. The display device 100 comprises a front panel 102, a first or left side panel 104, and a second or right side panel 106. The front panel 102 is similar in construction to the panel 12. The front panel 102 has a front surface or side 108, a first left side attachment device 110, a second left side attachment device 112, a first right side attachment device 114, a second right side attachment device 116, an upper attachment device 118, and a lower attachment device 120. By way of example only, the first left side attachment device 110 comprises a first tab portion 122 and a second tab portion 124. As can be appreciated, the tab portions 122 and 124 may be tied together. The tab portions 122 and 124 are each a generally rectangular piece of material. Each of the other attachment devices 112, 114, 116, 118, and 120 are similarly constructed. The panel 102 has the front side 108, a first or left side 126, a second or right side 128, an upper or top side 130, and a lower or bottom side 132. The first and second left attachment devices 110 and 112 extend out from the left side 126 and the first and second right attachment devices 114 and 116 extend out from the right side 128. The upper attachment device 118 extends out from the top side 130. The lower attachment device 120 extends out from the lower side 132. The front side 108 may have printed thereon various items such as a photograph 134. It is also contemplated that other items may appear or be printed on the front side 108 such as logos, advertisements, colors, pictures, famous paintings, a combination thereof, and any other printed matter.

The first or left side panel 104 comprises a front surface or side 136, a first left side attachment device 138, a second left side attachment device 140, a first right side attachment device 142, and a second right side attachment device 144. The first left side attachment device 138 may consist of a first tab portion 146 and a second tap portion 148. The tab portions 146 and 148 may be tied or attached together to secure the panel 104 to a walker, such as the walker 50. The other attachment devices 140, 142, and 144 are constructed in the same manner. The front surface 136 may also have printed thereon a photograph 150, such as a photograph of a family member of an individual that uses the device 100.

The second or right side panel 106 has a front surface or side 152, a first left side attachment device 154, a second left side attachment device 156, a first right side attachment device 158, and a second right side attachment device 160. The first left side attachment device 158 may consist of a first tab portion 162 and a second tap portion 164. The tab portions 162 and 164 may be tied or attached together to secure the panel 106 to a walker, such as the walker 50. The other attachment devices 156, 158, and 160 are constructed in the same manner. The front surface 152 may also have printed thereon a photograph 166 or other printed matter such as logos, advertisements, colors, pictures, famous paintings, a combination thereof, and any other printed matter.

Figure 5:
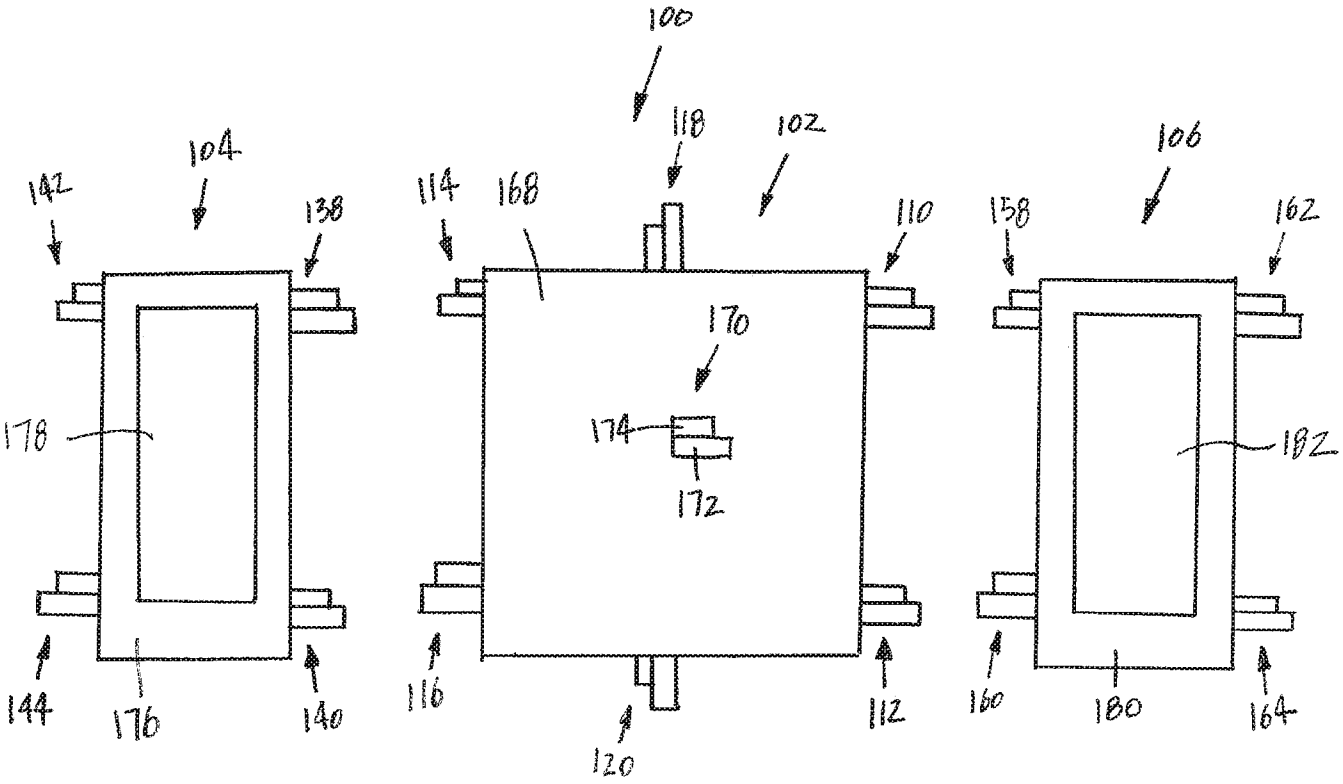
FIG. 5 is a back view of the display device for a walker shown in FIG. 4.

FIG. 5 depicts the display device 100 with the panels 102, 104, and 106 in reverse. The panel 102 has a back side 168 having a back attachment device 170 extending out from the back side 168. The back attachment device 170 comprises a first tab portion 172 and a second tab portion 174. The back attachment device 170 is used to attached or secure the back side 168 to one or more components of the walker 50. The panel 102 is also shown to have the other attachment devices 110, 112, 114, 116, 118, and 120, extending out from the panel 102. Although there is no printing on the back side 168 of the panel 102, it is possible that some printing may appear on the back side 168, such as an emergency number. The first or left side panel 104 has a back surface or side 176 having the attachment devices 138, 140, 142, and 144 extending out from the back side 176. The back surface 176 has a photograph 178 printed thereon to make the panel 104 reversible. The second or right side panel 106 has a back surface or side 180 having the attachment devices 158, 160, 162, and 164 extending out from the back side 186. The back side 180 also has a photograph 182 printed thereon.

Figure 6:
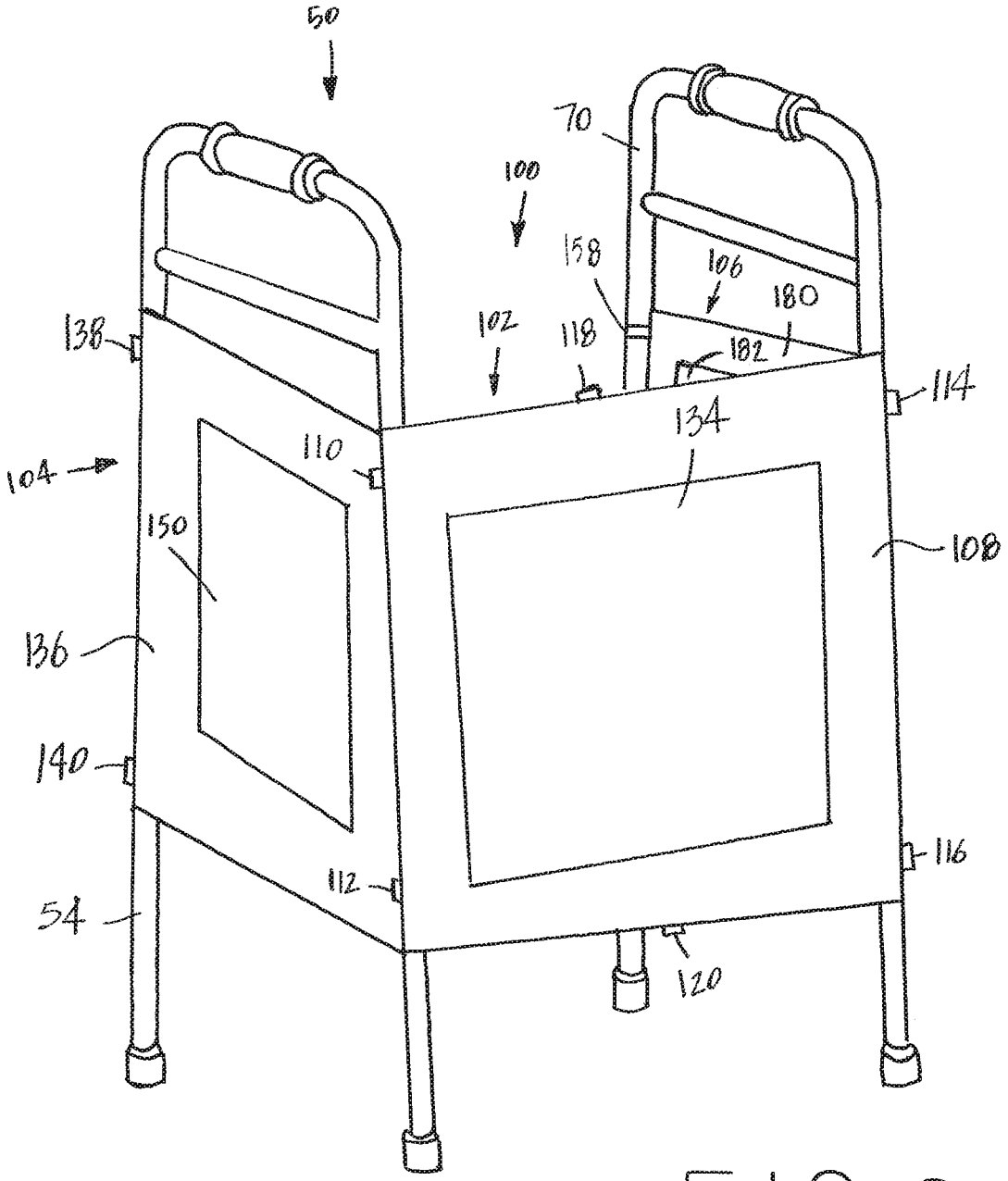
FIG. 6 is a perspective view of the display device for a walker shown in FIG. 4 being attached to a walker.

With reference now to FIG. 6, the panels 102, 104, and 106 of the display device 100 are shown attached to the walker 50. The front panel 102 is shown having the front surface or side 108, the first left side attachment device 110, the second left side attachment device 112, the first right side attachment device 114, the second right side attachment device 116, the upper attachment device 118, and the lower attachment device 120. The photograph 134 is also prominently displayed on the front side 108 of the panel 102. The left panel 104 is shown having the front side 136 and the first left side attachment device 138 and the second left side attachment device 140 visible and attached to the left side rear leg member 54 of the walker 50. The photograph 150 is also shown. The back side 180 of the right side panel 106 is visible in this particular view. The right side panel 106 is shown being attached to the right side rear leg member 70 by use of the first right side attachment device 158. The photograph 182 that appears on the back side 180 is also depicted. As desired, the panels 104 and 106 may be reversed and attached to the walker 50 to present different views for the sides of the walker 50.

Figure 7:
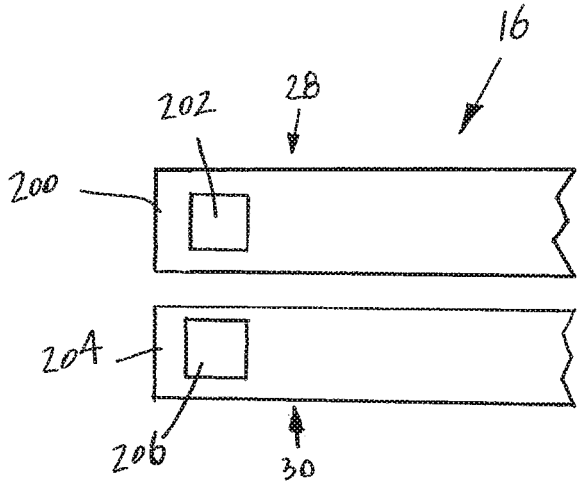
FIG. 7 is a partial view of an attachment device constructed according to the present disclosure.

FIG. 7 illustrates an enlarged partial view of, for example, the attachment device 16. The attachment device 16 has the first tab member 28 and the second tab member 30 which are not attached to each other. The first tab member 28 has a first end 200 having a portion of hook material 202 and the second tab member 30 has a second end 204 having a portion of loop material 206 with the hook material 202 for mating with the loop material 204 to secure the first tab member 28 to the second tab member 30. Although the materials 202 and 206 are shown, it is possible to construct the attachment device 16 without these materials 202 and 206 and only have the members 28 and 30 tied to each other. However, the materials 202 and 206 are preferred in order for the panel 12 to be easily attached or removed from the walker 50.

Figure 8:
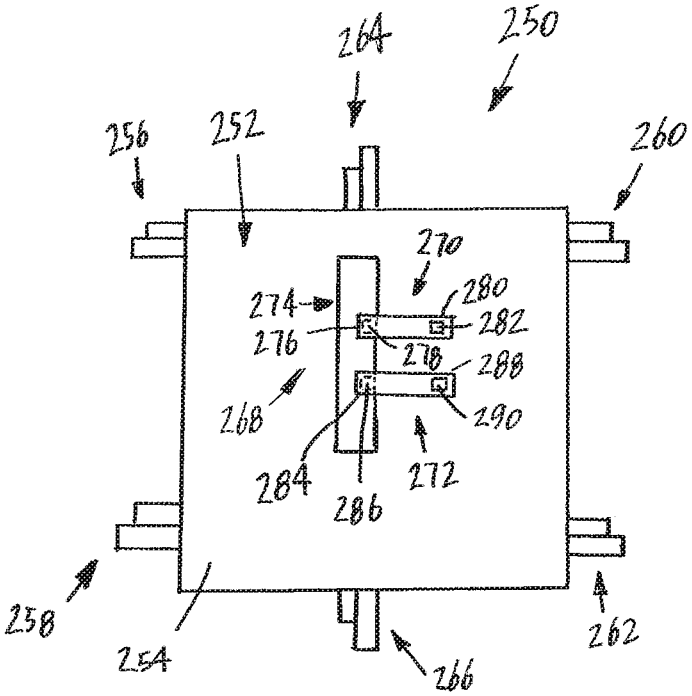
FIG. 8 is a back view of another display device for a walker constructed according to the present disclosure shown partially in phantom.

Referring now in particular to FIG. 8, a back view of another display device for a walker 250 constructed according to the present disclosure is shown with some parts being shown partially in phantom. The display device for a walker 250 comprises a panel 252 having a back side or surface 254, a first left side attachment device 256, a second left side attachment device 258, a first right side attachment device 260, a second right side attachment device 262, an upper attachment device 264, a lower attachment device 266, and an adjustable back attachment device 268. The adjustable back attachment device 268 comprises a first tab member 270, a second tab member 272, and a portion of hook material 274. The first tab member has a first end 276 having a portion of loop material 278 (shown in phantom) and a second end 280 having a portion hook material 282. The portion of loop material 278 is used for mating with the portion of hook material 274. The second tab member 272 has a first end 284 having a portion of loop material 286 and a second end 288 having a portion of loop material 290. The loop material 286 of the first end 284 is used for mating with the hook material 274. The loop material 290 of the second end 288 is used for mating with the hook material 282 of the second end 280 of the first tab member 270 for mating the ends 280 and 288 together. As can be appreciated, the first ends 276 and 284 are adjustable along the portion 274. Depending upon where a particular cross member (not shown) of the walker 50 is, the adjustable back attachment device 268 can be positioned to secure the panel 252 to the walker 50. Further, it is possible to have more than one adjustable back attachment device 268 associated on the back side 254 of the panel 252. Although not shown, it is also possible that the attachment devices 256, 258, 260, 262, 264, and 266 may be made adjustable by use of other portions of hook material 274. Also, although a portion of hook material 274 is used, a portion of loop material may be used and the other portions 278 and 286 may be made from hook material.

Figure 9:
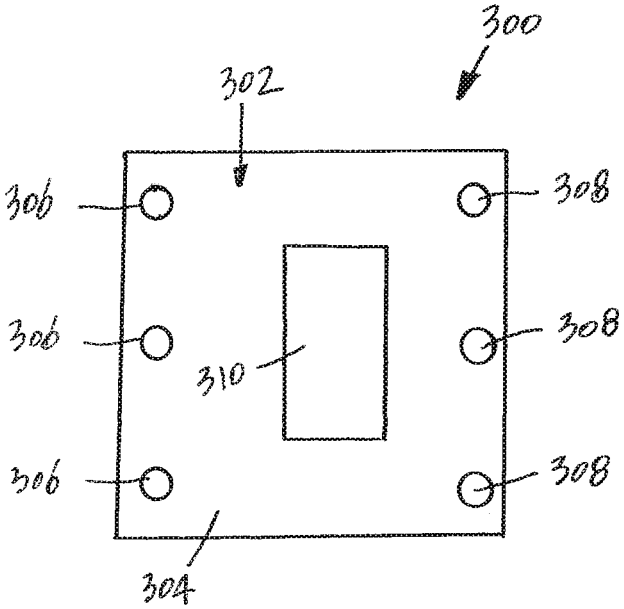
FIG. 9 a front view of another embodiment of a display device for a walker constructed according to the present disclosure.

FIG. 9 illustrates a front view of another embodiment of a display device for a walker 300. The display device for a walker 300 comprises a panel 302 having a front surface or side 304, a series of left side grommets 306, and a series of right side grommets 308. The front side 304 also has a photograph 310 printed thereon. Although not show, various attachment devices may be used in combination with the grommets 306 and 308 to attach the panel 302 to the walker 50. It is also possible that more or less grommets 306 and 308 may be used. It is further contemplated that other grommets may be required on the top and bottom of the panel 302 depending on the application and the particular walker that the display device 300 will be attached.

Figure 10:
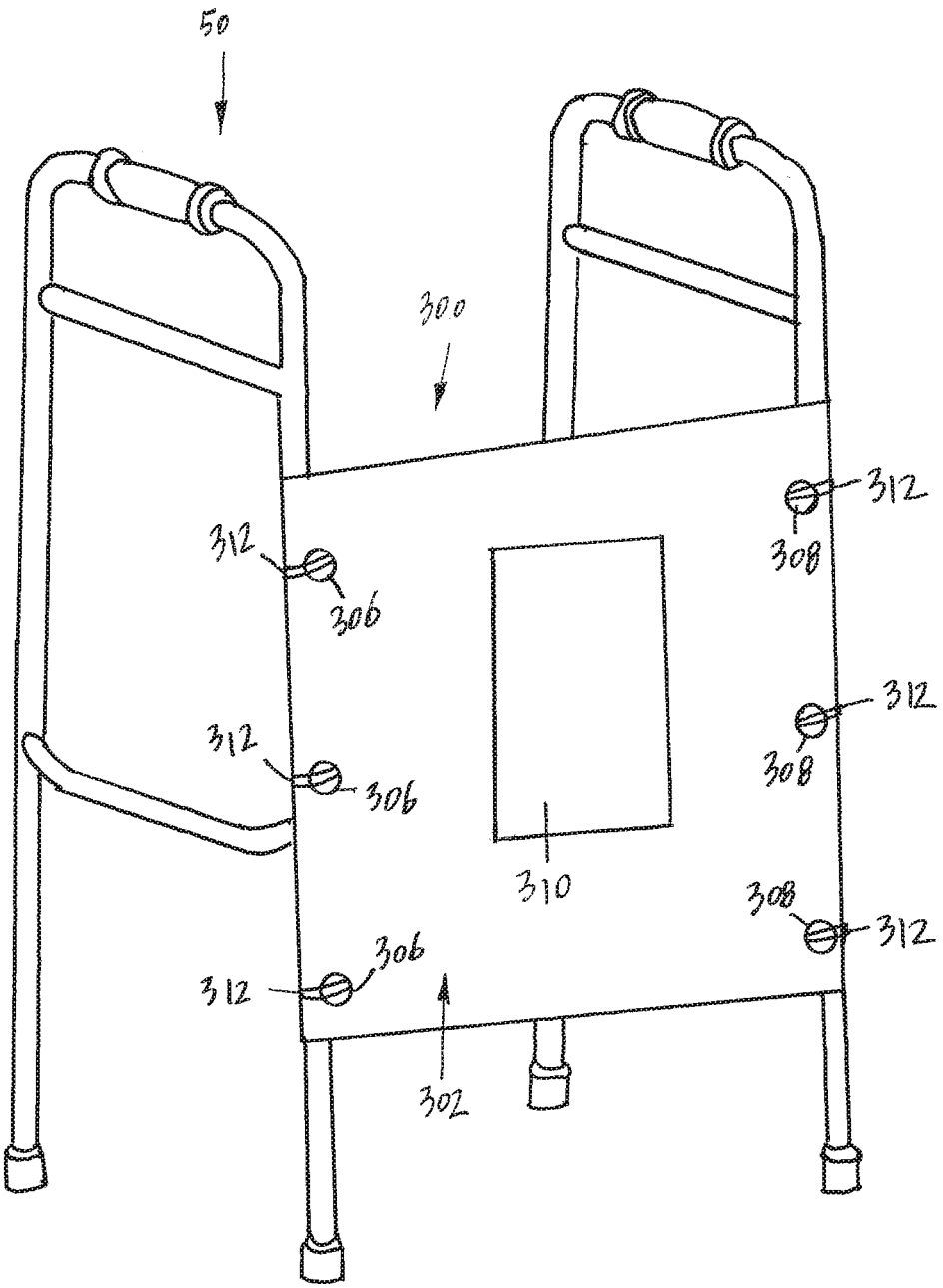
FIG. 10 is a perspective view of the display device for a walker shown in FIG. 9 being attached to a walker.

With reference now to FIG. 10, the display device for a walker 300 is illustrated being attached to the walker 50. A number of ties, strings, or twist ties 312 have been inserted through the grommets 306 and 308 to attach the panel 302 to the walker 50. Other devices may be used to attach the panel 302 to the walker 50 such as wire, plastic ties, and attachment devices such as attachment device 16. The photograph 310 is also shown being displayed on the front side 304.

Figure 11:
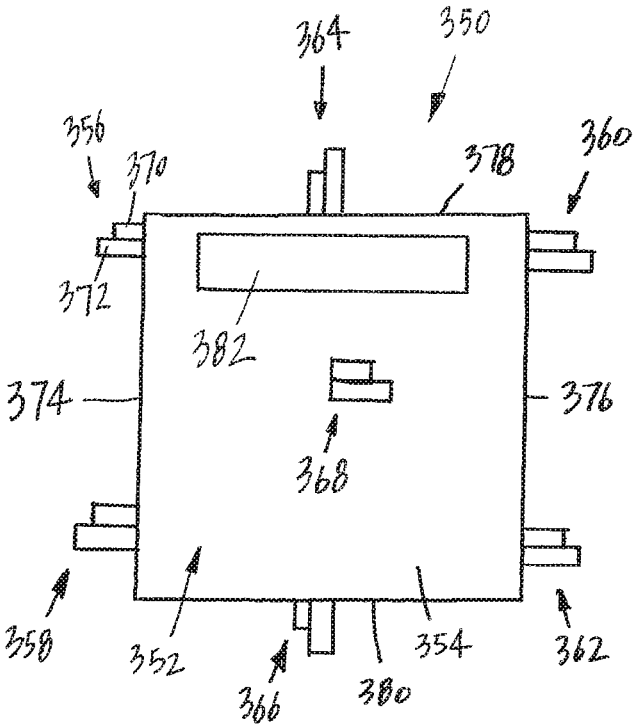
FIG. 11 is a back view of another embodiment of a display device for a walker constructed according to the present disclosure.

FIG. 11 shows another embodiment of a display device for a walker 350 constructed according to the present disclosure. The display device for a walker 350 comprises a panel 352 having a back surface or side 354, a first left side attachment device 356, a second left side attachment device 358, a first right side attachment device 360, a second right side attachment device 362, an upper attachment device 364, a lower attachment device 366, and a back attachment device 368. By way of example only, the first left side attachment device 356 comprises a first tab portion 370 and a second tab portion 372. As can be appreciated, the tab portions 370 and 372 may be tied together or may include hook and loop material to secure the tab portions 370 and 372. Each of the other attachment devices 358, 360, 362, 364, 366, and 368 are similarly constructed. The panel 352 has the back side 354, a first or left side 374, a second or right side 376, an upper or top side 378, and a lower or bottom side 380. The first and second left attachment devices 356 and 358 extend out from the left side 374 and the first and second right attachment devices 360 and 362 extend out from the right side 376. The upper attachment device 364 extends out from the top side 378. The lower attachment device 366 extends out from the lower side 380. The back side 354 also has a pocket 382 for storing items therein. Although not shown, the panel 352 has a front side on which may be printed a photograph or other printed matter.

Figure 12:
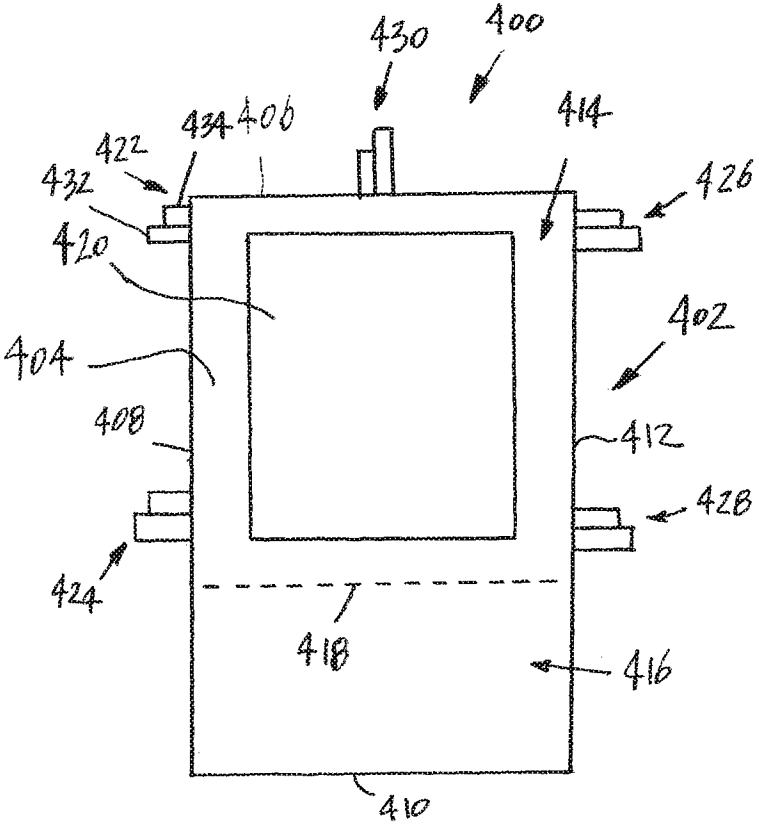
FIG. 12 is a front view of another embodiment of a display device for a walker constructed according to the present disclosure in an unfolded state.

Referring now to FIG. 12, another embodiment of a display device for a walker 400 is shown. The display device 400 comprises a panel 402 having a front side 404, an upper side 406, a left side 408, a lower side 410, and a right side 412. The panel 402 has an upper portion 414 and a lower portion 416 separated by a fold line 418. A photograph 420 may be printed in the upper portion 414. The photograph 420 is shown not extending into the lower portion 416. However, it is possible that the photograph 420 may span both the upper portion 414 and the lower portion 416. The left side 408 has a first left side attachment device 422 and a second left side attachment device 424. The right side 412 has a first right side attachment device 426 and a second right side attachment device 428. The upper portion 414 has an upper attachment device 430. The first left side attachment device 422 comprises a first tab portion 432 and a second tab portion 434. The tab portions 432 and 434 may be tied together. The tab portions 432 and 434 are each a generally rectangular piece of material. Each of the other attachment devices 424, 426, 428, and 430 are similarly constructed. Also, as has been disclosed above, the attachment devices 422, 424, 426, 428 and 430 may incorporate hook and loop fastening material for purposes of securing the attachment devices 422, 424, 426, 428 and 430 to a walker. In this particular embodiment, the upper portion 414 may be double in size as that of the lower portion 416. However, as should be appreciated, any particular dimensions for the upper portion 414 and the lower portion 416 are contemplated and possible.

Figure 13:
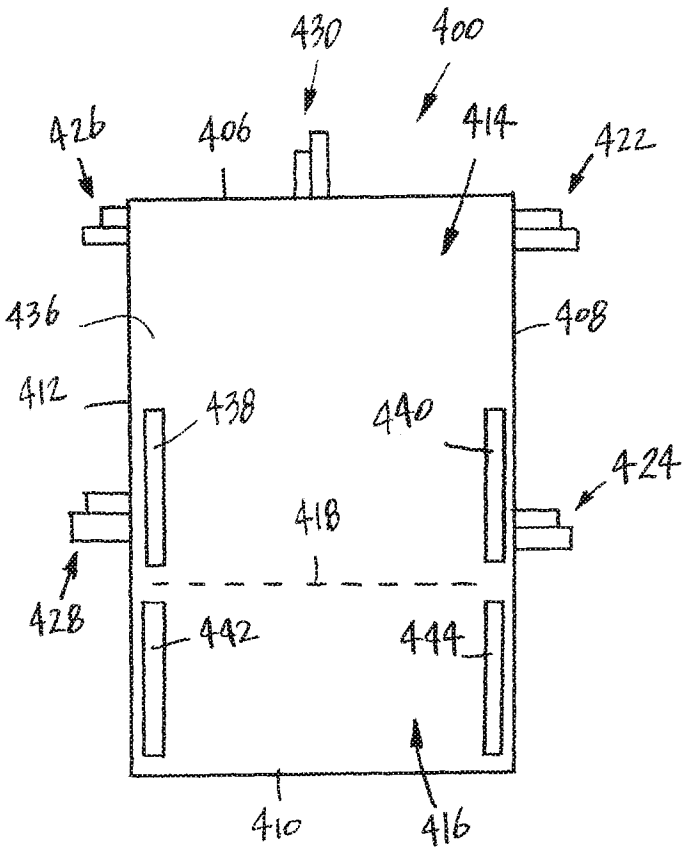
FIG. 13 is a back view of the display device for a walker shown in FIG. 12.

FIG. 13 illustrates a back view of the display device 400. The display device 400 has the panel 402 having a back side 436, the upper side 406, the left side 408, the lower side 410, and the right side 412. The back side 436 also has the upper portion 414, the lower portion 416, and the fold line 418. The upper portion 414 has a first upper strip of hook and loop fastening material 438 and a second upper strip of hook and loop fastening material 440. The lower portion 416 has a first lower strip of hook and loop fastening material 442 and a second lower strip of hook and loop fastening material 444. The material 438 and the material 442 will mate together and the material 440 and the material 444 will mate together when the lower portion 416 is folded up over the upper portion 414. The attachment devices 422, 424, 426, 428 and 430 are also shown in this particular view.

Figure 14:
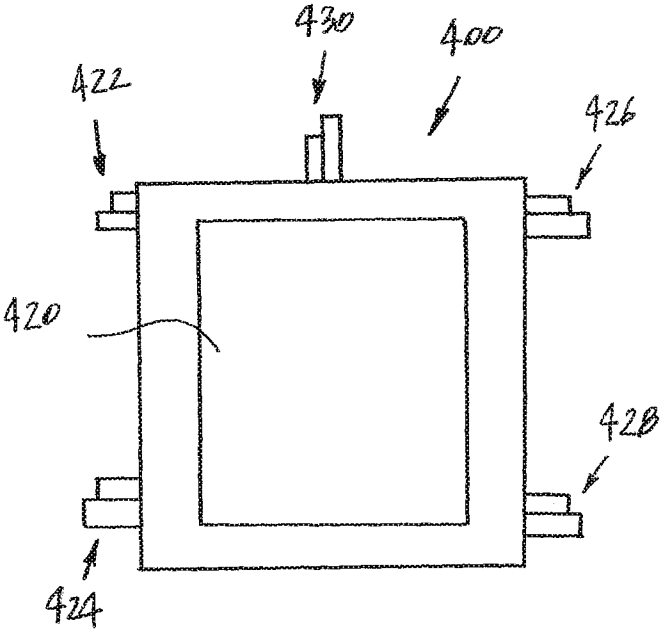
FIG. 14 is a front view of the display device for a walker shown in FIG. 12 in a folded state.

With particular reference now to FIG. 14, the display device 400 being in a folded position or state is shown. The display device 400 displays the photograph 420 in the folded state. The lower portion 416 is no longer visible when the display device 400 is in the folded state.

Figure 15:
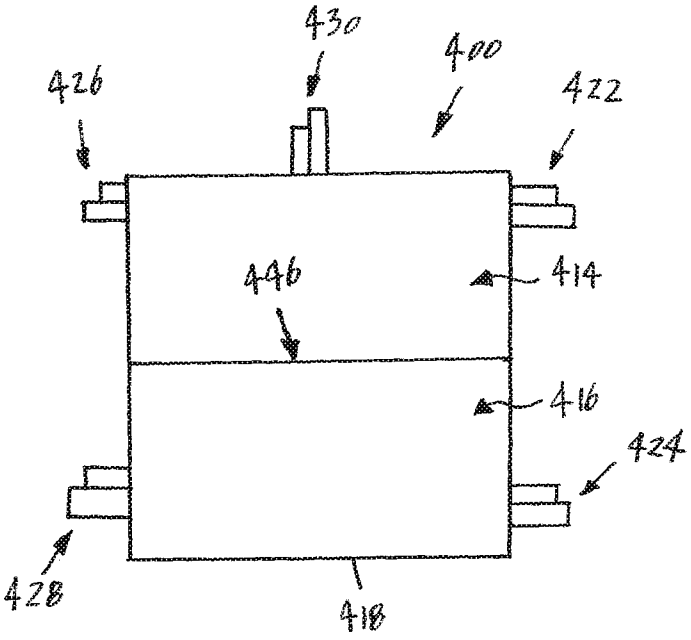
FIG. 15 is a back view of the display device for a walker shown in FIG. 14.

FIG. 15 depicts a back view of the display device 400 being in the folded position or state. The display device 400 has the lower portion 416 folded at the fold line 418. The strips of material 438, 440, 442, and 444 have mated with each other to secure the lower portion 416 to the upper portion 414. In this manner, a pocket 446 is formed between the lower portion 416 and the upper portion 414. An individual using the display device 400 may place any items into the pocket 446. As indicated above, since the upper portion 414 was double the size of the lower portion 416, with the display device 400 being in the folded state, the pocket 446 is half the size of the upper portion 414. Again, as discussed, the various dimensions of the portions 414 and 416 can be varied depending on the application. The attachment devices 422, 424, 426, 428 and 430 are also shown in this particular view.

Preferably, the display devices for a walker 10, 100, 250, 300, 350, and 400 will be constructed of a relatively lightweight material so that it can be easily handled, installed, and removed from the walker 50. It is further contemplated that the display devices for a walker 10, 100, 250, 300, 350, and 400 may have any visual material printed thereon and such visual material may be selected or provided by the user of the display device. It is also possible that an individual will have more than one display device to customize the appearance of the walker with various photographs, logos, or other visual images or items for various times of the year or for holidays.

From all that has been said, it will be clear that there has thus been shown and described herein a display device for a walker which fulfills the various objects and advantages sought therefor. It will be apparent to those skilled in the art, however, that many changes, modifications, variations, and other uses and applications of the subject display device for a walker are possible and contemplated. All changes, modifications, variations, and other uses and applications which do not depart from the spirit and scope of the disclosure are deemed to be covered by the disclosure, which is limited only by the claims which follow.

What is claimed is:

1. A display device for a walker comprising:

a panel having a front surface, a back surface, a left side, a right side, an upper side, a lower side, printed matter printed on the front surface, an upper portion and a lower portion separated by a fold line;

a first left side attachment device and a second left side attachment device each extending out from the left side of the panel;

a first right side attachment device and a second right side attachment device each extending out from the right side of the panel;

an upper attachment device extending out from the upper side; and the back surface having the upper portion, the lower portion, the fold line, a first upper strip of hook and loop fastening material along the left side, a second upper strip of hook and loop fastening material along the right side, a first lower strip of hook and loop fastening material along the left side, a second lower strip of hook and loop material along the right side with the first upper strip of hook and loop fastening material mating to the first lower strip of hook and loop fastening material along the left side and the second upper strip of hook and loop fastening material mating to the second lower strip of hook and loop fastening material along the right side when the lower portion is folded up over the upper portion for forming a pocket.

2. The display device for a walker of claim 1 wherein the first left side attachment device comprises a first tab member and a second tab member.

3. The display device for a walker of claim 2 wherein the first tab member of the first left side attachment device comprises a first end having a portion of hook material and the second tab member of the first left side attachment device comprises a second end having a mating portion of loop material with the hook material for mating with the loop material to secure the first tab member to the second tab member.

4. The display device for a walker of claim 1 wherein the back attachment device comprises a first tab member and a second tab member.

5. The display device for a walker of claim 4 wherein the first tab member of the back attachment device comprises a first end having a portion of hook material and the second tab member of the back attachment device comprises a second end having a portion of loop material with the hook material for mating with the loop material to secure the first tab member to the second tab member.

6. The display device for a walker of claim 1 wherein the back surface of the panel further comprises a portion of hook material and the back attachment device comprises a first tab member having a first end having a portion of loop material and a second end having a portion hook material, the portion of loop material for mating with the portion hook material on the back surface, and a second tab member having a first end having a portion of loop material and a second end having a portion of loop material with the loop material of the first end for mating with the hook material on the back surface and the loop material of the second end for mating with the hook material of the second end of the first tab member for mating the second end of the first tab member to the second end of the second tab member.

7. A display device for a walker having a front side, a left side, and a right side, the display device for a walker comprising:

a front panel having a front surface, a back surface, a left side, a right side, an upper side, a lower side, printed matter printed on the front surface, an upper portion and a lower portion separated by a fold line, a first left side attachment device and a second left side attachment device each extending out from the left side of the panel, a first right side attachment device and a second right side attachment device each extending out from the right side of the panel, an upper attachment device extending out from the upper side, the back surface having the upper portion, the lower portion, the fold line, a first upper strip of hook and loop fastening material along the left side, a second upper strip of hook and loop fastening material along the right side, a first lower strip of hook and loop fastening material along the left side, a second lower strip of hook and loop material along the right side with the first upper strip of hook and loop fastening material mating to the first lower strip of hook and loop fastening material along the left side and the second upper strip of hook and loop fastening material mating to the second lower strip of hook and loop fastening material along the right side when the lower portion is folded up over the upper portion for forming a pocket, the front panel for attachment to the front side of the walker;

a left side panel having a front surface, a back surface, a left side, a right side, an upper side, a lower side, and printed mater on the front surface, a first left side attachment device and a second left side attachment device each extending out from the left side of the panel, a first right side attachment device and a second right side attachment device each extending out from the right side of the panel, the left side panel for attachment to the left side of the walker; and a right panel having a front surface, a back surface, a left side, a right side, an upper side, a lower side, and printed mater on the front surface, a first left side attachment device and a second left side attachment device each extending out from the left side of the panel, a first right side attachment device and a second right side attachment device each extending out from the right side of the panel, the right side panel for attachment to the right side of the walker.

8. The display device for a walker of claim 7 wherein the front surface of the left side panel has printed matter thereon.

9. The display device for a walker of claim 7 wherein the printed matter is a photograph.

10. The display device for a walker of claim 7 wherein the front surface of the right side panel has printed matter thereon.

11. The display device for a walker of claim 7 wherein the first left side attachment device comprises a first tab member and a second tab member.

12. The display device for a walker of claim 11 wherein the first tab member comprises a first end having a portion of hook material and the second tab member comprises a second end having a mating portion of loop material with the hook material for mating with the loop material to secure the first tab member to the second tab member.

13. The display device for a walker of claim 7 wherein the back attachment device comprises a first tab member and a second tab member.

14. The display device for a walker of claim 13 wherein the first tab member of the back attachment device comprises a first end having a portion of hook material and the second tab member of the back attachment device comprises a second end having a portion of loop material with the hook material for mating with the loop material to secure the first tab member to the second tab member.

15. The display device for a walker of claim 7 wherein the back surface of the front panel further comprises a portion of hook material and the back attachment device comprises a first tab member having a first end having a portion of loop material and a second end having a portion hook material, the portion of loop material for mating with the portion hook material on the back surface, and a second tab member having a first end having a portion of loop material and a second end having a portion of loop material with the loop material of the first end for mating with the hook material on the back surface and the loop material of the second end for mating with the hook material of the second end of the first tab member for mating the second end of the first tab member to the second end of the second tab member.

16. A display device for a walker comprising:

a panel having a front surface, a back surface, a left side, a right side, an upper side, a lower side, printed matter printed on the front surface, an upper portion and a lower portion separated by a fold line;

a series of grommets positioned along the left side of the panel;

a series of grommets positioned along the right side of the panel;

a number of attachment devices for insertion through the grommets for attaching the panel to a walker; and the back surface having the upper portion, the lower portion, the fold line, a first upper strip of hook and loop fastening material along the left side, a second upper strip of hook and loop fastening material along the right side, a first lower strip of hook and loop fastening material along the left side, a second lower strip of hook and loop material along the right side with the first upper strip of hook and loop fastening material mating to the first lower strip of hook and loop fastening material along the left side and the second upper strip of hook and loop fastening material mating to the second lower strip of hook and loop fastening material along the right side when the lower portion is folded up over the upper portion for forming a pocket.

17. The display device for a walker of claim 16 wherein the back side has printed matter thereon.

18. The display device for a walker of claim 16 wherein the number of attachment devices comprises a number of twist ties.

19. The display device for a walker of claim 16 wherein the printed matter is a photograph.

20. The display device for a walker of claim 16 wherein the back side has printed matter thereon and the panel is reversible.

* * * * *